US008213838B2

(12) United States Patent
Noh et al.

(10) Patent No.: US 8,213,838 B2
(45) Date of Patent: Jul. 3, 2012

(54) DEVELOPING APPARATUS, IMAGE FORMING APPARATUS HAVING THE SAME, AND DEVELOPER SUPPLYING METHOD FOR A DEVELOPING APPARATUS

(75) Inventors: Joo-Hwan Noh, Yongin-Si (KR); Jong-Moon Eun, Yongin-Si (KR); Jean-Man Sur, Suwon-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 681 days.

(21) Appl. No.: 12/191,682

(22) Filed: Aug. 14, 2008

(65) Prior Publication Data

US 2009/0214268 A1 Aug. 27, 2009

(30) Foreign Application Priority Data

Feb. 22, 2008 (KR) ..... 10-2008-0016455

(51) Int. Cl.
*G03G 15/08* (2006.01)

(52) U.S. Cl. ..... 399/258

(58) Field of Classification Search ..... 399/110, 399/111, 120, 258, 263
See application file for complete search history.

(56) References Cited

U.S. PATENT DOCUMENTS

| | | | | |
|---|---|---|---|---|
| 4,967,234 | A | 10/1990 | Tani et al. | |
| 4,974,020 | A | 11/1990 | Takamatsu et al. | |
| 4,977,429 | A | 12/1990 | Tani et al. | |
| 5,479,247 | A | 12/1995 | Watanabe et al. | |
| 5,493,366 | A | 2/1996 | Satoh et al. | |
| 5,499,077 | A | 3/1996 | Endo et al. | |
| 5,589,915 | A | 12/1996 | Hashimoto | |
| 5,659,860 | A | 8/1997 | Sasaki et al. | |
| 5,797,073 | A | 8/1998 | Russell | |
| 5,960,238 | A | 9/1999 | Ohgami | |
| 6,041,212 | A | 3/2000 | Okada | |
| 6,104,888 | A | 8/2000 | Kobayashi | |
| 6,151,459 | A | 11/2000 | Hashimoto et al. | |
| 6,591,079 | B2 * | 7/2003 | Ota et al. | 399/262 |
| 6,792,230 | B2 | 9/2004 | Saito et al. | |

(Continued)

FOREIGN PATENT DOCUMENTS

CN 1225457 8/1999

(Continued)

OTHER PUBLICATIONS

English Language abstract of KR 91/1489, published Jan. 31, 1991.

(Continued)

*Primary Examiner* — David Gray
*Assistant Examiner* — Barnabas Fekete
(74) *Attorney, Agent, or Firm* — Stanzione & Kim, LLP

(57) ABSTRACT

A developing apparatus usable with an image forming apparatus includes a developer cartridge having an outlet through which developer is discharged, a developing cartridge, in which the developer cartridge is detachably disposed, has an inlet, through which the developer discharged from the outlet of the developer cartridge enters, and a connecting member connecting the outlet of the developer cartridge and the inlet of the developing cartridge so that the developer is supplied from the developer cartridge to the developing cartridge, wherein through the arrangement of the developer cartridge, the developing cartridge and the connecting member, the flow of developer from the developer cartridge to the developing cartridge is regulated based on the developer pressure in the developing cartridge.

31 Claims, 13 Drawing Sheets

U.S. PATENT DOCUMENTS

| | | | | |
|---|---|---|---|---|
| 6,980,758 | B2 | 12/2005 | Murayama et al. | |
| 7,340,197 | B2 | 3/2008 | Murayama et al. | |
| 2002/0085857 | A1 | 7/2002 | Kim et al. | |
| 2002/0085887 | A1 | 7/2002 | Schneider et al. | |
| 2003/0161653 | A1 | 8/2003 | Ban et al. | |
| 2004/0001723 | A1 | 1/2004 | Ashida et al. | |
| 2004/0223772 | A1 | 11/2004 | Nakazato | |
| 2004/0265009 | A1 * | 12/2004 | Shigeta et al. | 399/254 |
| 2005/0047821 | A1 | 3/2005 | Murayama et al. | |
| 2005/0095020 | A1 | 5/2005 | Eom et al. | |
| 2005/0260011 | A1 | 11/2005 | Murayama et al. | |
| 2006/0210285 | A1 | 9/2006 | Nakazato | |
| 2006/0285880 | A1 | 12/2006 | Okabe | |
| 2007/0230999 | A1 * | 10/2007 | Shimomura | 399/113 |
| 2008/0056772 | A1 | 3/2008 | Utsumi et al. | |
| 2009/0129813 | A1 | 5/2009 | Nagashima | |

FOREIGN PATENT DOCUMENTS

| | | | |
|---|---|---|---|
| EP | 0 570 993 | A1 | 11/1993 |
| EP | 0 672 971 | | 9/1995 |
| EP | 1 437 632 | | 7/2004 |
| EP | 1 840 671 | | 10/2007 |
| EP | 1 881 378 | | 1/2008 |
| JP | 60-238873 | | 11/1985 |
| JP | 01-091164 | | 4/1989 |
| JP | 09-022177 | | 1/1997 |
| JP | 10-142910 | | 5/1998 |
| JP | 11-24513 | | 1/1999 |
| JP | 2000-75627 | | 3/2000 |
| JP | 2000-075659 | | 3/2000 |
| JP | 2004-264539 | | 9/2004 |
| JP | 2005-326637 | | 11/2005 |
| JP | 2005-338329 | | 12/2005 |
| JP | 2007-025511 | | 2/2007 |
| KR | 91-1489 | | 1/1991 |
| KR | 10-2001-0061976 | | 7/2001 |
| KR | 10-2005-0033796 | | 4/2005 |
| KR | 10-2006-0034168 | | 4/2006 |
| KR | 10-2006-0128338 | | 12/2006 |
| RU | 2266553 | | 4/2005 |
| WO | 2006/093362 | | 9/2006 |

OTHER PUBLICATIONS

Korean Office Action issued in Application No. 10-2008-0016464, mailed Feb. 6, 2009.
Korean Office Action issued in Application No. 10-2008-0016467, mailed Jan. 30, 2009.
English language abstract of KR 10-2006-0034168, published Apr. 21, 2006.
English language abstract of JP 09-022177, published Jan. 21, 1997.
Machine English language translation of JP 09-022177, published Jan. 21, 1997.
Korean Office Action issued in Application No. 10-2008-0016472, mailed Feb. 5, 2009.
English language abstract of KR 10-2005-0033796, published Apr. 13, 2005.
Korean Office Action issued in Application No. 10-2008-0016469, mailed Feb. 6, 2009.
English language abstract of KR 10-2001-0061976, published Jul. 7, 2001.
Russian Decision on Grant issued Jun. 2, 2010 in RU Application No. 2008148667.
European Search Report issued in EP 09 15 0144, issued Jan. 22, 2010.
English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.
European Search Report Issued in European Application No. 09 15 0066, mailed Jul. 29, 2009.
European Search Report Issued in European Application No. 09 15 2590, mailed Aug. 17, 2009.
European Search Report issued in EP 09150067.8, mailed Jun. 3, 2009.
English language abstract of JP 60-238873, published Nov. 27, 1985.
English language abstract of JP 01-091164, published Apr. 10, 1989.
Office Action issued in KR 10-32008-0016469, mailed Jun. 3, 2009.
English language abstract of JP 2005-326637, mailed Nov. 24, 2005.
Machine English language translation of JP 2005-326637, mailed Nov. 24, 2005.
Office Action issued in Russian patent application No. 2008148636, mailed Oct. 28, 2009.
English language translation of Office Action issued in Russian patent application No. 2008148636, mailed Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
English language abstract of JP 2005-338329, published Dec. 8, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English lanouage translation of JP 2007-025511, published Feb. 1, 2007.
Korean Office Action issued in Application No. 10-2008-0016455, issued Jan. 23, 2009.
English abstract of KR 10-2006-0128338, published Dec. 14, 2006.
European Search Report issued in European Application No. 09 15 0141, mailed Apr. 14, 2009.
Chinese Office Action issued Apr. 13, 2011 in CN Application No. 200810215317.1.

* cited by examiner

DEVELOPING APPARATUS, IMAGE FORMING APPARATUS HAVING THE SAME, AND DEVELOPER SUPPLYING METHOD FOR A DEVELOPING APPARATUS

CROSS-REFERENCE TO RELATED APPLICATIONS

This application claims the benefit under 35 U.S.C. §119 (a) from Korean Patent Application No. 2008-16455 filed Feb. 22, 2008 in the Korean Intellectual Property Office, the disclosure of which is incorporated herein by reference in its entirety.

BACKGROUND OF THE INVENTION

1. Field of the Invention

The present invention relates generally to an image forming apparatus. More particularly, various aspects of the present invention relates to apparatus for, and methods of, supplying developer in an image forming apparatus.

2. Description of the Related Art

An image framing apparatus, such as, for example, a printer, a photocopier, a facsimile machine, a multifunction peripheral, or the like, performs printing of images using developer. After repeated printing operations, the developer may be used up, and thus may need to be replenished.

To replenish, a developing cartridge storing the developer therein may need to be replaced. However, the developing cartridge may also include other components, such as, e.g., a developing roller and/or a supply roller, which may have relatively longer useful life. Replacement of the developing cartridge for the purpose of developer replenishment may thus be uneconomical.

The present applicants have contemporaneously herewith suggested a separable type developing cartridge with a removable developer cartridge that allows the developer to be replenished with replacement of only the removable developer cartridge. However, while the removable developer cartridge may alleviate the need for unnecessary replacement of the entire developing cartridge, it may become necessary to control the supply of developer from the removable developer cartridge to the developing cartridge in order not to oversupply the developing cartridge.

For example, when an oversupply of developer in the developing cartridge occurs, the developer may scatter and/or leak out of the developing cartridge, and contaminate components of the mage forming apparatus and/or cause unwanted marks on the images formed on a printing medium. It is also possible that, when the developer is oversupplied, a pressure inside the developing cartridge may increase so as to increase the driving load necessary to drive the components of the developing cartridge, and may even result in a mechanical damage of the developer supplying mechanism of the image forming apparatus.

BRIEF DESCRIPTION OF TOE DRAWINGS

Various aspects and utilities of the present invention will become apparent and more readily appreciated from the following description of the embodiments, taken in conjunction with the accompanying drawings of which:

DETAILED DESCRIPTION OF SEVERAL EMBODIMENTS

Figure 1:
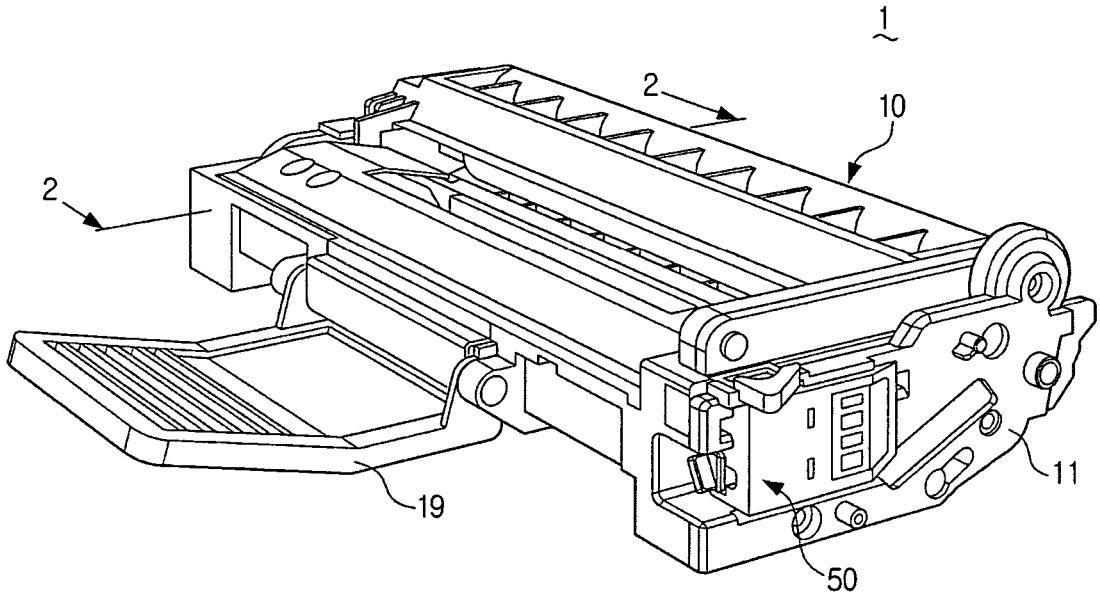
FIG. 1 is a perspective view illustrating a developing apparatus usable with an image forming apparatus according to an embodiment of the present invention.

Reference will now be made to the embodiments of the present invention, examples of which are illustrated in the accompanying drawings, wherein like reference numerals refer to the like elements throughout. The matters defined in the description, such as a detailed constructions, configurations, arrangements and/or elements thereof are provided merely to assist in a comprehensive understanding of the embodiments, and may not be all required to practice the various aspects of the present invention. Thus, it should however be readily apparent that aspects of the present inventive concept may be carried out without those details described herein. For the sake of brevity, and in order to avoid obscuring the description with unnecessary detail, well-known functions or constructions will not be described in detail herein.

Figure 2:
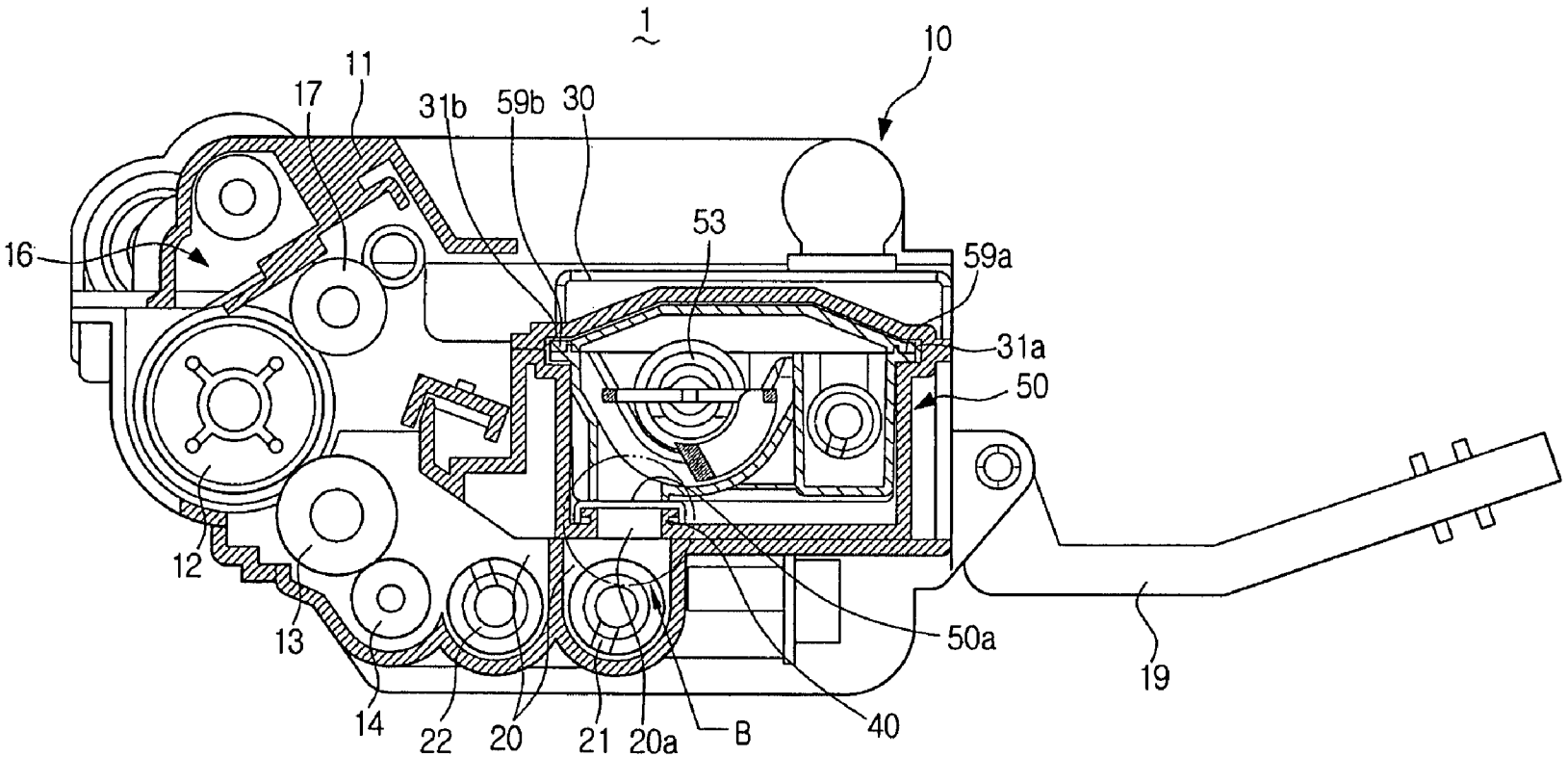
FIG. 2 is a sectional view illustrating the developing apparatus of FIG. 1 taken along a line 2-2 in FIG. 1.
Figure 3:
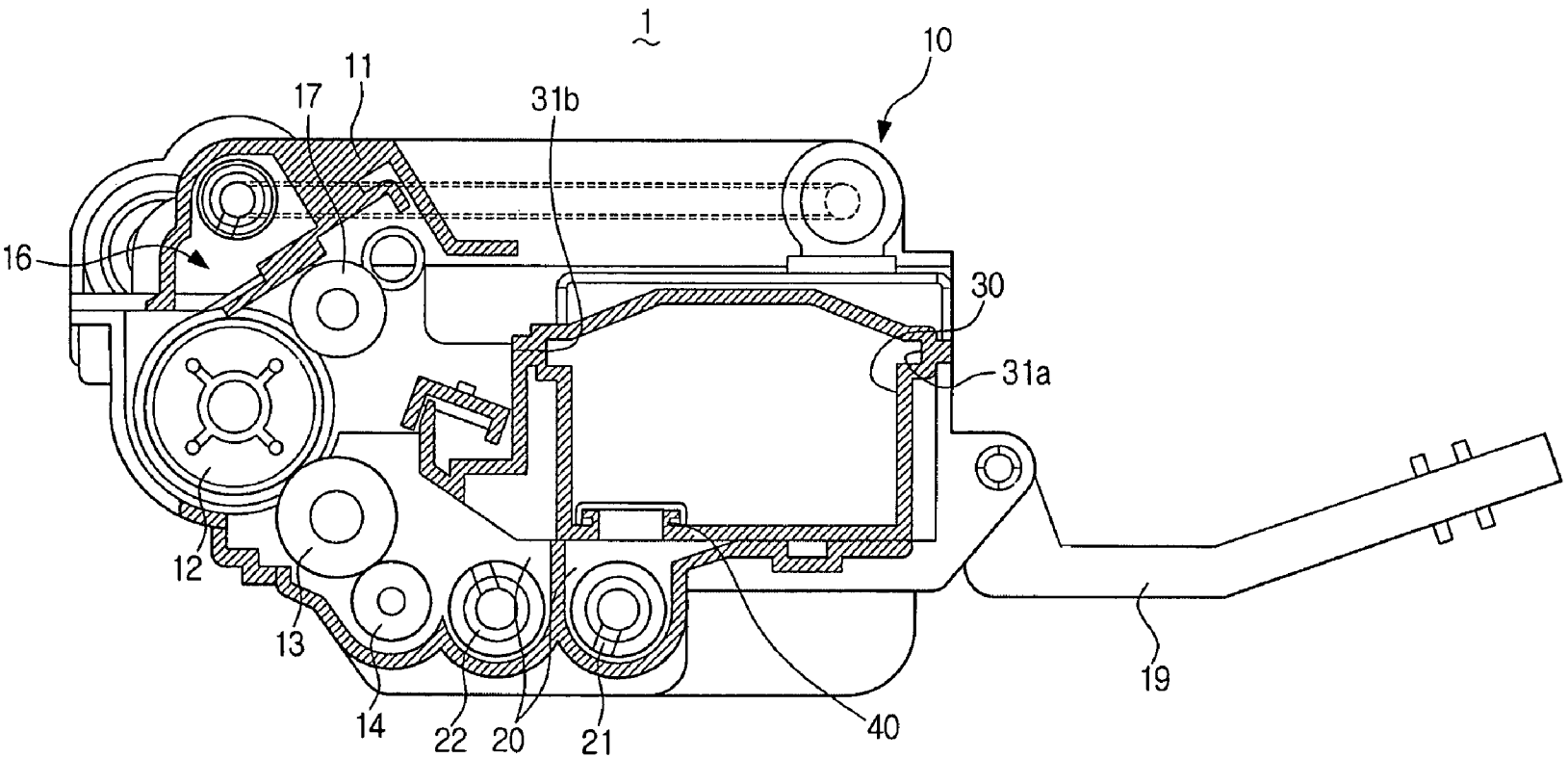
FIG. 3 is a sectional view illustrating the developing apparatus of FIG. 2 without the developer cartridge mounted.

FIG. 1 is a perspective view illustrating a developing apparatus 1 usable with an image forming apparatus according to an embodiment of the present invention. FIG. 2 is a sectional view illustrating the developing apparatus 1 of FIG. 1 taken along a line 2-2 in FIG. 1. FIG. 3 is a sectional view illustrating the developing apparatus 1 of FIG. 2 when no developer cartridge is mounted in the developing apparatus.

Referring to FIGS. 1 to 3, the developing apparatus 1 according to an embodiment may include a developing cartridge 10, to which the developer cartridge 50 may be removably received.

The developing cartridge 10 may include a housing 11, an image carrier 12, a developing roller 13, a developer-storing portion 20, and a mounting recess 30.

The housing 11 forms the external appearance of the developing cartridge 10, and may support therein the image carrier 12 and/or the developing roller 13. A folding handle 19 may be disposed at a side of the housing 11. The handle 19 may be used when the developing cartridge 10 is mounted to and separated, from the image forming apparatus 100 (see FIG. 15).

According to an embodiment; the image carrier 12 may be rotatably disposed inside the housing 11, and a portion of the image carrier 12 may be exposed to outside of the housing 11 through an opening formed at the housing 11. An image carrier-cleaning unit 16 to remove developer remaining on the image carrier 12 and a charging roller 17 to charge a surface of the image carrier 12 may also be disposed adjacent the image carrier 12. In this embodiment, the image carrier 12 is provided as housed within the developing cartridge 10. Alternatively, however, the image carrier 12 may be provided separate from the developing cartridge 10.

The developing roller 13 is rotatably disposed in the housing 11 adjacent the image carrier 12 for supplying the image carrier 12 with the developer from the developer-storing portion 20. A developer-supplying roller 14 may also be provided to convey developer to the developing roller 13 from the developer-storing portion 20.

Figure 4:
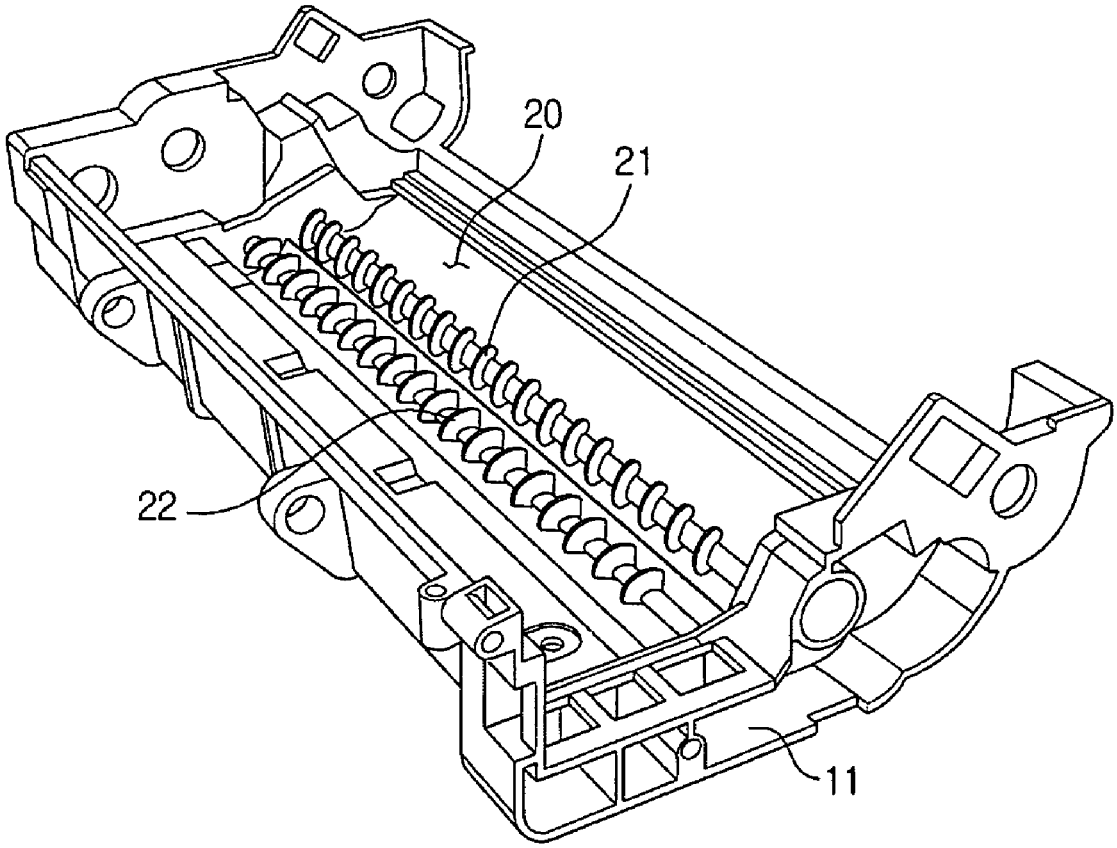
FIG. 4 is a partial perspective view illustrating a developing cartridge of the developing apparatus of FIG. 2 in which supply developer-conveying members are disposed.

The developer-storing portion 20 is formed inside the housing 11 to store an amount of developer. One or more supply developer-conveying member 21 and 22 may also be disposed in the developer-storing portion 20, for conveying and/or for circulating the developer stored in the developer-storing portion 20. In the embodiment shown in FIG. 4, two supply developer-conveying members 21 and 22 are disposed side by side in the developer-storing portion 20. However, arty number in other arrangement of the supply developer conveying members may alternatively be provided. FIG. 4 is a partial perspective view illustrating the housing 11 of the developing cartridge 10 according to an embodiment with two supply developer-conveying members 21 and 22.

Figure 5:
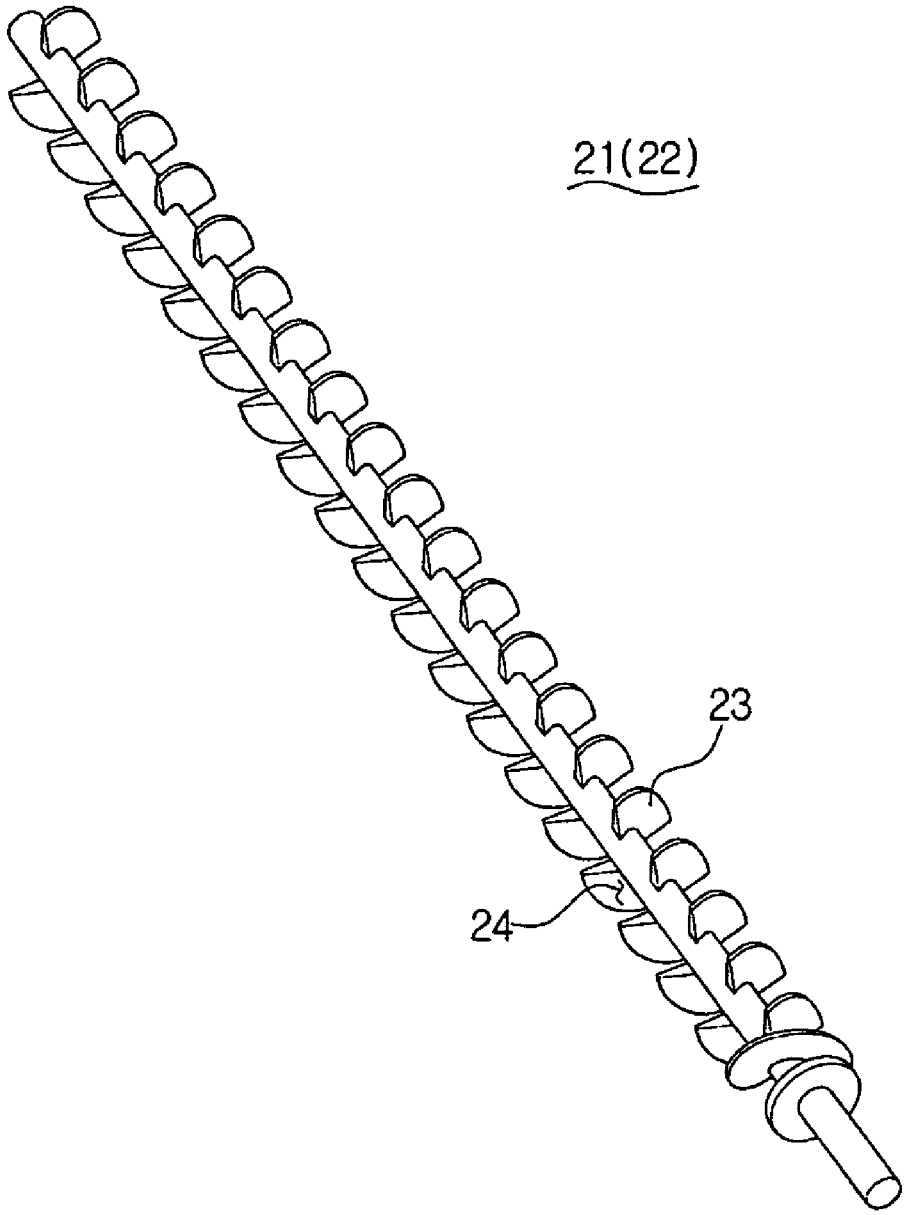
FIG. 5 is a perspective view illustrating the supply developer-conveying member of FIG. 4.

In the embodiment illustrated in FIG. 5, the supply developer-conveying members 21 and 22 may be formed, e.g., substantially in a helical screw shape. Blades 23 with a width may be cut along the axial direction of the helical screw. The cut portions 24 of the supply developer-conveying member 21 and 22 remaining after the forming of the blades 23 may limit the pressure increase Inside the developing cartridge 10. For example, when the pressure inside the developing cartridge 10 partially increases due to, e.g., partial developer cohesion, etc., the cut portions 24 of she supply developer-conveying member 21 and 22 may exhibit a relatively lower pressure so that the developer in a high pressure region may move toward the cut portions 24 of the supply developer-conveying member 21 and 22, relieving the pressure inside the developing cartridge. Also, when the helical screw with partially cut blades 23 is used as the developer-conveying member 21 and 22, the amount of the developer inside the developer-storing portion 20 may be maintained substantially uniformly in the axial direction of the developer-conveying member 21 and 22. As a result, an image density deviation caused by deviation of the amount of the developer in the axial direction of the developer-conveying member 21 and 22 may also be reduced. In an alternative embodiment, the supply developer-conveying member 21 and 22 may be formed substantially in a hollow helical screw shape similar to a discharge developer-conveying member 53 as described below.

As illustrated in FIGS. 2 and 3, an inlet 20*a* is formed at the housing 11 above the developer-storing portion 20. The developer discharged from an outlet 50*a* of the developer cartridge 50 enters through the inlet 20*a*. The inlet 20*a* may be formed in various shapes. In this embodiment illustrated in FIG. 6, the inlet 20*a* is formed as substantially a hexagon.

A connecting member 40 may be disposed above the inlet 20*a*. When the developer cartridge 50 is mounted to the developing cartridge 10, the connecting member 40 allows the outlet 50*a* of Hie developer cartridge 50 to be in communication with the inlet 20*a* of the developing cartridge 10, thereby allowing the developer to move between the developer cartridge 50 and the developing cartridge 10. The connecting member 40 may be formed separately and disposed at the inlet 20*a*. In the embodiment illustrated in FIGS. 2 and 3, the connecting member 40 is formed to extend and project from the inlet 20*a* of the housing 11. An inner section of the connecting member 40 is formed to correspond to a shape of any one of the outlet 50*a* of the developer cartridge 50 or the inlet 20*a* of the housing 11 of the developing cartridge 10. For example, when the sectional shape of the inlet 20*a* is formed as substantially a hexagon as illustrated in FIG. 6, the inner sectional shape of the connecting member 40 may be formed in a hexagon corresponding to the sectional shape of the inlet 20*a*.

Figure 7:
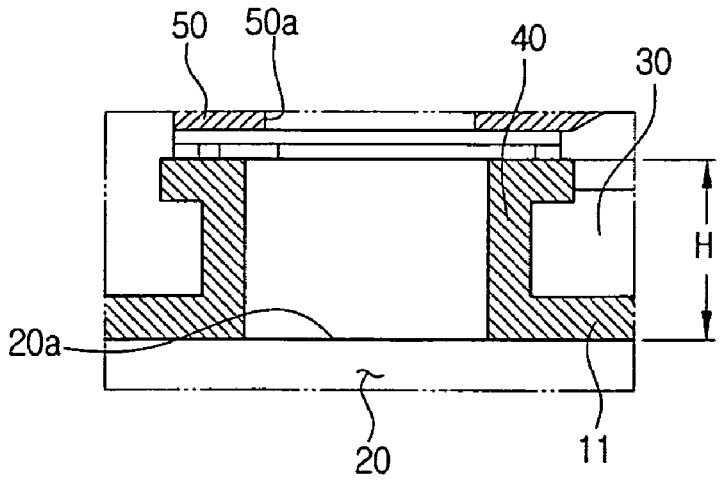
FIG. 7 is a partial enlarged sectional view illustrating a portion B of the developing apparatus of FIG. 2.

The connecting member 40 may have a predetermined height H (see FIG. 7) so that when the developer cartridge 50 is mounted to the developing cartridge 10, the developer can flow back through the connecting member 40 according to the discharging pressure in the outlet 50*a* of the developer cartridge 50 and the entering pressure in foe inlet 20*a* of the developing cartridge 10. According to an embodiment, the dimension of the maximum width W of the inlet 20*a* of the developing cartridge 10 may be larger than the dimension of the height H of the connecting member 40. In an embodiment, the outlet 50*a* of the developer cartridge 50 may have the same shape as that of the inlet 20*a* of the developing cartridge 10 so that the height H of the connecting member 40 may also be smaller than the maximum width W of the outlet 50*a* of the developer cartridge 50.

Furthermore, according to an embodiment in allowing the above-described operation, the area of the inner section A (a hatched portion in FIG. 6) of the connecting member 40 may be made to be at least ten times the height H of foe connecting member 40. That is, the connecting member 40 may be formed to satisfy an inequality $A \geqq 10 \times H$. In considering the above inequality condition, so long as a common base measurement unit is used, for example, mm for the linear measurement (e.g., the height H) and $mm^2$ for the area A, etc., the units of the dimensions may be ignored, and only the numerical values may be considered.

Figure 6:
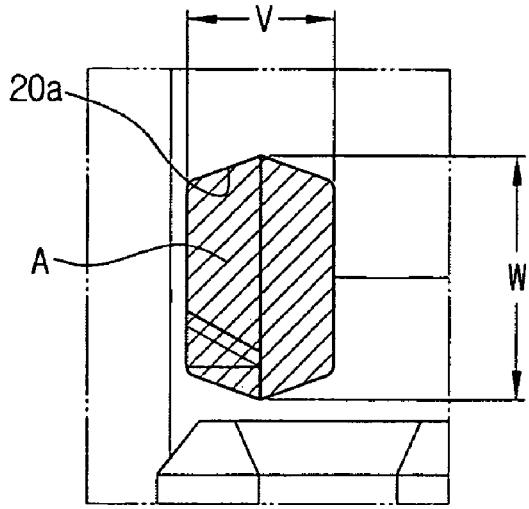
FIG. 6 is a partial plan view illustrating an inlet of a developing cartridge of the developing apparatus of FIG. 2.

For example, referring to FIG. 6, the inlet 20*a* of the developing cartridge 10 according to this embodiment has a hexagonal shape with a maximum width W of approximate 12 mm, a minimum width V of approximate 8 mm, and a section area A of approximate 90 $mm^2$. The height H of the connecting member 40 for this example may be approximate 2 mm to 5 mm. Therefore the maximum width W of the inlet 20*a* of the developing cartridge 10 is larger than the height H of the connecting member 40. Also, the section area A of the inlet 20*a* of the developing cartridge 10 is 90 and ten times the height H of the connecting member 40 is approximate 20 to 50. Accordingly, the above inequality is satisfied.

Figure 8:
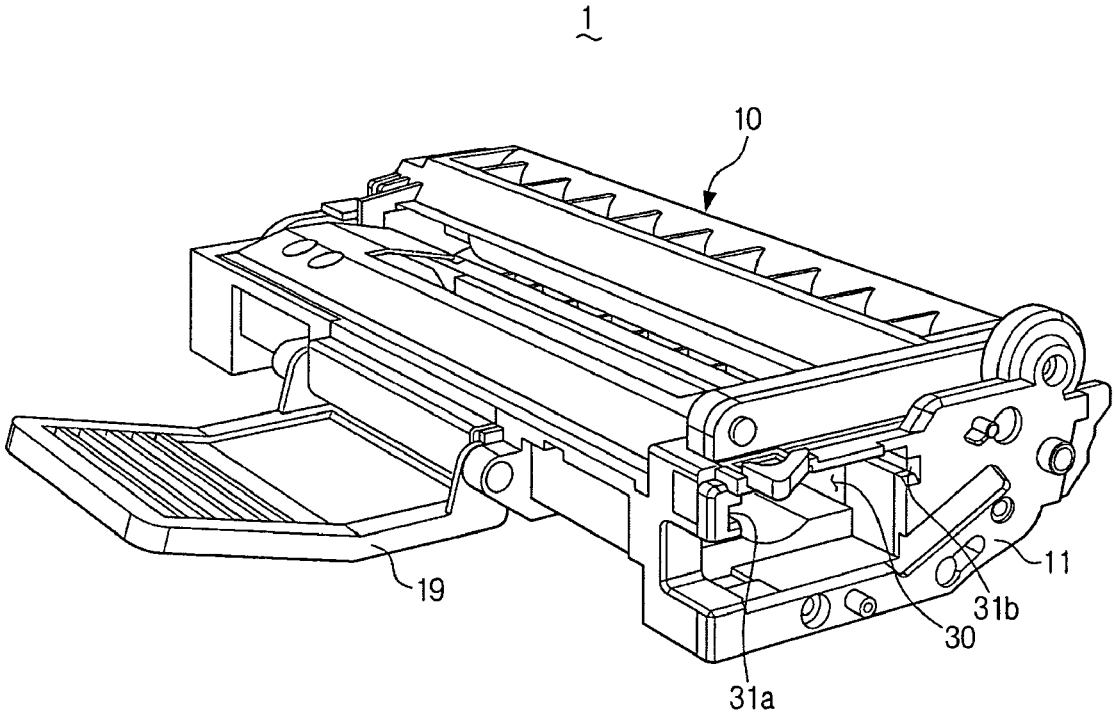
FIG. 8 is a perspective view illustrating the developing apparatus of FIG. 1 without the developer cartridge mounted.

Referring to FIG. 8, the mounting recess 30 may be formed in a shape corresponding to the developer cartridge 50 in the housing 10 so that the developer cartridge 50 can be detachably mounted into the mounting recess 30. The mounting recess 30 may be formed to extend parallel to the developing roller 13. At least one mounting guiding groove 31*a* and 31*b* may be formed in the mounting recess 30 to guide the developer cartridge 50 when being mounted.

Also, the developer cartridge 50 may have at least one mounting guide 59*a* and 59*b* corresponding to the at least one mounting guiding groove 31*a* and 31*b* formed in the mounting recess 30. In the embodiment illustrated in FIG. 2, two mounting guiding grooves 31*a* and 31*b* are formed on opposite sides of the mounting recess 30 while the developer cartridge 50 has two mounting guides 59*a* and 59*b* corresponding to the two mounting guiding grooves 31*a* and 31*b*.

A power-transmitting member (not illustrated) to transmit a power to the discharge developer-conveying member 21(22) or 53 (see FIGS. 4 and 9) of the developer cartridge 50 may disposed at the bottom of the mounting recess 30. The connecting member 40 may be disposed on the surface of the mounting recess 30 adjacent to the developer-storing portion 20. When the developer cartridge 50 is mounted into the mounting recess 30, the outlet 50*a* of the developer cartridge 50 may be aligned with, and in fluid communication with, the inlet 20*a* of the developing cartridge 10.

Figure 9:
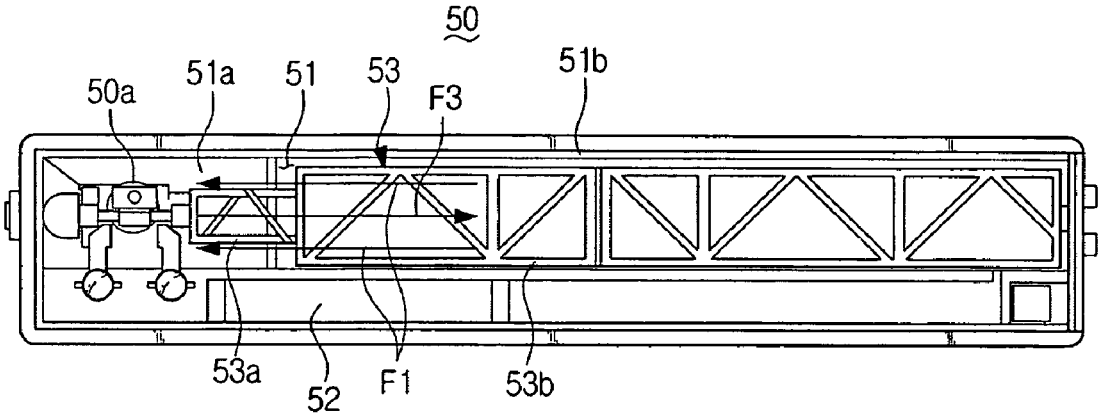
FIG. 9 is a plan view illustrating a developer cartridge of the developing apparatus of FIG. 1 when a top surface of the developer cartridge is removed.
Figure 10:
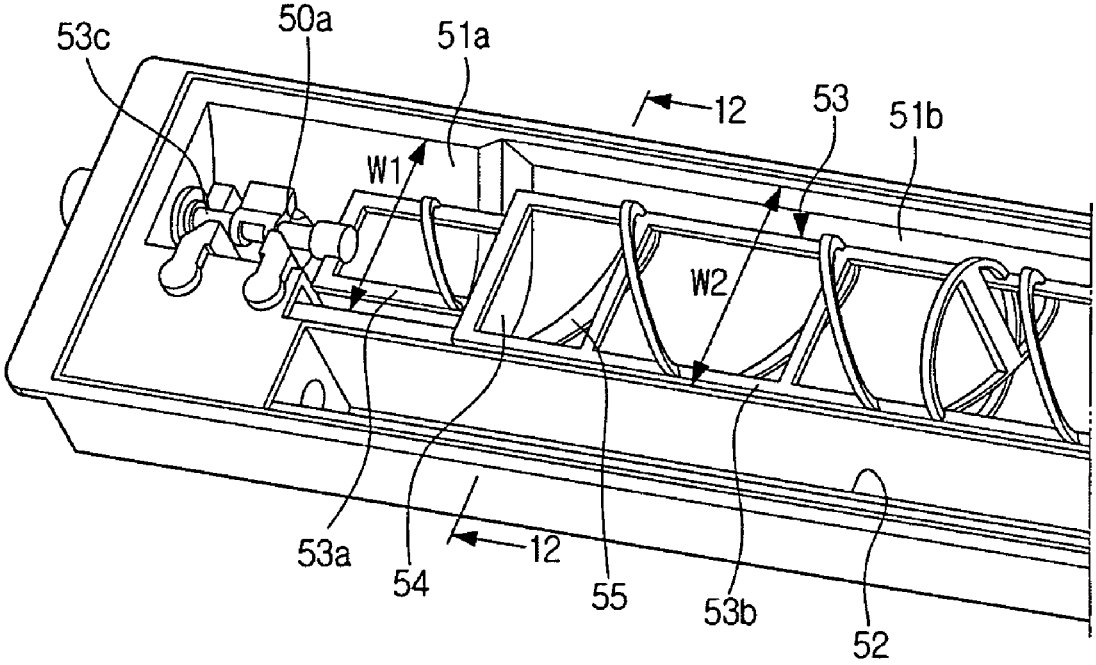
FIG. 10 is a partial perspective view illustrating the developer cartridge of the developing apparatus of FIG. 9.

Referring to FIGS. 9 and 10, the developer cartridge 50 may be formed in generally a rectangular parallelepiped shape. A developer-receiving portion 51 in which a predetermined amount of developer may be stored is formed inside the developer cartridge 50. The discharge developer-conveying member 53 is rotatably disposed in the developer-receiving portion 51. A waste developer-receiving portion 52 may optionally be disposed at a side of the developer-receiving portion 51 parallel to the developer-receiving portion 51. The waste developer-receiving portion 52 may receive waste developer removed from the image carrier 12 by the image carrier-cleaning unit 16.

The outlet 50*a* is formed on the bottom surface of the developer cartridge 50. The developer stored in the developer-receiving portion 51 is moved to the outlet 50*a* by the discharge developer-conveying member 53, and is discharged outside the developer cartridge 50 through the outlet 50*a*. The bottom, surface of the developer-receiving portion 51 may be stepped as illustrated in FIG. 10. That is, the bottom surface of the first portion 51*a* of the developer-receiving portion 51 close to the outlet 50*a* may be higher than the bottom surface of the second portion 53*b* of the developer-receiving portion 51 away from the outlet 50*a*, and in which the developer is generally stored. If the bottom surface of the first portion 51*a* in which the outlet 50*a* is formed is higher than the bottom surface of the second portion 51*b* in which the developer is stored, a pressure being applied to the outlet 50*a* by the developer stored in the developer-receiving portion 51 may be maintained at a lower level.

Figure 11:
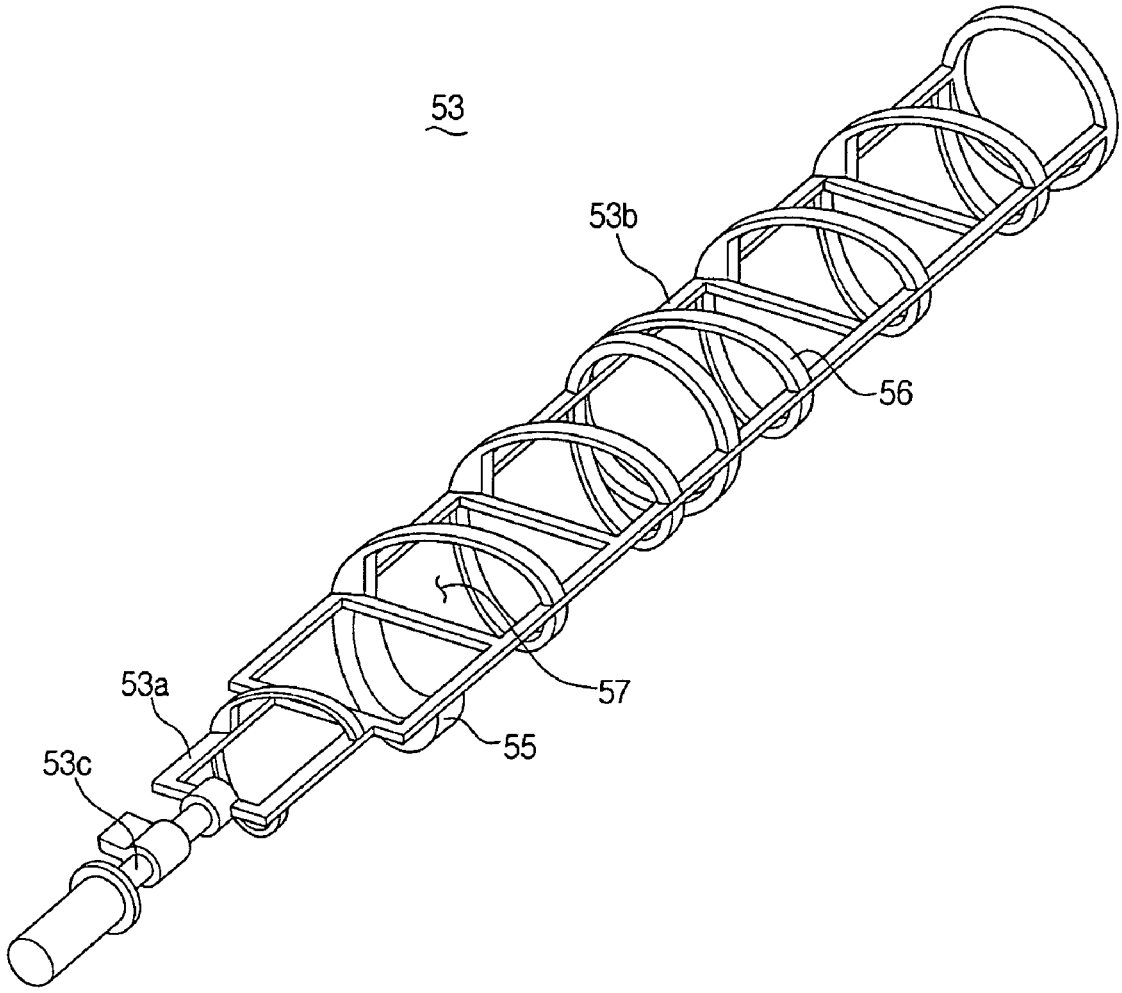
FIG. 11 is a perspective view illustrating a developer-conveying member disposed in the developer cartridge of the developing apparatus of FIG. 9.

The discharge developer-conveying member 53, as illustrated in FIG. 11, includes a conveying portion 56 to convey the developer to the outlet 50*a*, and a backflow portion 57 through which the developer can move in a direction opposite to the direction in which the developer is conveyed by the conveying portion 56 when the pressure in the vicinity of the outlet 50*a* of the developer cartridge 50 increases. In this embodiment, the discharge developer-conveying member 53 is formed in substantially a hollow helical screw shape. The helical blade of the screw corresponds to the conveying portion 56 that conveys the developer to the outlet 50*a* while the hollow portion of the screw corresponds to the backflow portion 57 through which the developer moves from the outlet 50*a* in the direction opposite to the discharging direction of the developer.

When there is more than a predetermined amount of developer in the developer-receiving portion 51 of the developer cartridge 50, the developer is moved toward the outlet 50*a* by an axial conveying force generated by the hollow helical screw 53 of FIG. 11 (see arrows F1 in FIG. 9). At this time, the hollow portion 57 of the helical screw 53 may exhibit a relatively lower pressure than the other portion. Therefore, when a developer pressure in the vicinity of the outlet 50*a* (that is, the discharging pressure) increases to over a certain value, although the helical screw 53 rotates, the developer may stop from moving in the direction F1, and may gather in the hollow portion 57 of the helical screw 53 having the relatively lower pressure. As the pressure in the vicinity of the outlet 50*a* further increases, the developer that was gathered in the hollow portion 57 of the helical screw 53 may move along the hollow portion 57 in the direction opposite to the axial conveying force of the helical screw 53 (see arrow F3 in FIG. 9). The developer may continue to flow backward until the pressure in the vicinity of the outlet 50*a* becomes substantially the same as that of the hollow portion 57 of the helical screw 53. This process allows the decrease of the high pressure in the vicinity of the outlet 50*a* of the developer cartridge 50. As a result, when the developer pressure in the vicinity of the outlet 50*a* increases over a certain pressure level during the developer movement toward the outlet 50*a* inside the developer cartridge 50, the discharge developer-conveying member 53 according to the embodiment may allow the developer pressure to be lowered.

Figure 12:
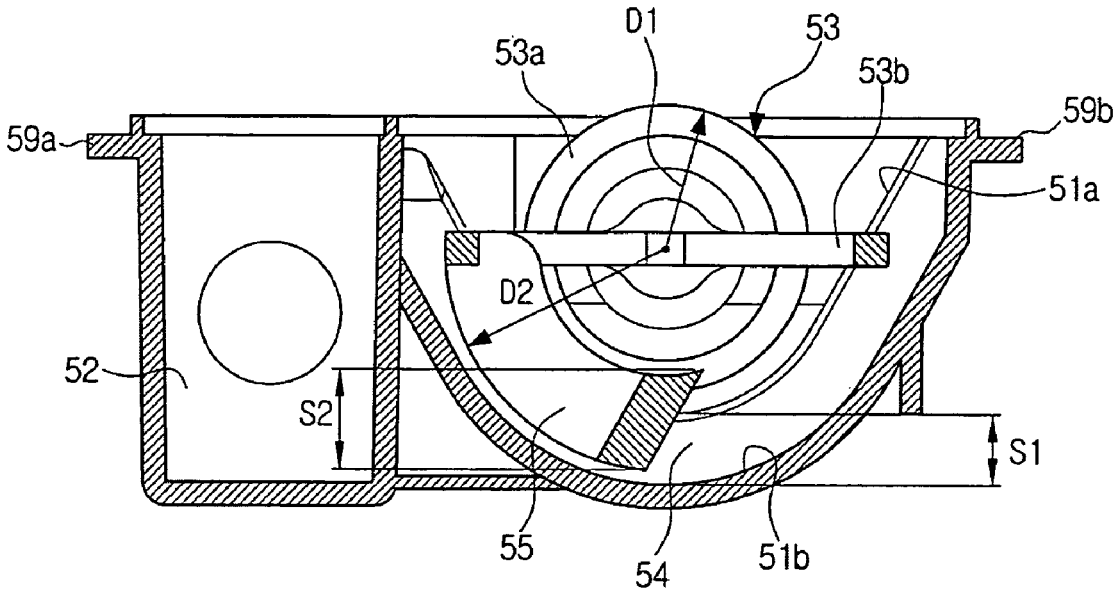
FIG. 12 is a sectional view illustrating the developer cartridge of FIG. 10 taken along a line 12-12 in FIG. 10.

Also, the discharge developer-conveying member 53, as illustrated in FIGS. 10 to 12, may include a small diameter portion 53*a* corresponding to the bottom surface of the first portion 51*a* of the developer-receiving portion 51, a large diameter portion 53*b* corresponding to the bottom surface of the second portion 51*b* of the developer-receiving portion 51, and a driving shaft 53*c*. A difference between the diameter D2 of the large diameter portion 53*b* and the diameter D1 of the small diameter portion 53*a* of the discharge developer-conveying member 53 may correspond to the height difference between the bottom surface of the first portion 51*a* and the bottom surface of the second portion 51*b*, that is, the height S1 of the stepped portion 54 of the developer-receiving portion 51. The driving shaft 53*c* may receive the power from the power-transmitting member (not illustrated) disposed in the mounting recess 30 of the developing cartridge 10.

Furthermore, the large diameter portion 53*b* of the discharge developer-conveying member 53 may be formed so that each of the blades 56 of the screw has an increasing width as getting closer toward the small diameter portion 53*a*. At this time, the large diameter portion 53*b* of the discharge developer-conveying member 53 may be formed so that the width S2 of die blade 55 of the large diameter portion 53*b* nearby the small diameter portion 53*a*, that is, the blade 55 of the large diameter portion 53*b* nearby the stepped portion 54 of the developer-receiving portion 51, has the size larger than the size of the height S1 of the stepped portion 54 of the developer-receiving portion 51. When the width of the blade 55 of the large diameter portion 53*b* nearby the stepped portion 54 is large as above described, the discharge developer-conveying member 53 can effectively convey the developer from the lower height developer-receiving portion 51 to the higher height outlet 50*a*.

Alternatively, the large diameter portion 53*b* of the discharge developer-conveying member 53 may be formed so feat only one blade 55 nearby the small diameter portion 53*a* has a width larger than those of the blades 56 in other portions. At this time, the width S2 of the blade 55 of the large diameter portion 53*b* nearby the small diameter portion 53*a* may have a size larger than the size of the height S1 of the stepped portion 54 of the developer-receiving portion 51. According to an embodiment, the large diameter portion 53*b* of the discharge developer-conveying member 51 may be formed to have the wider width blade 55 in approximately a half turn.

In the above embodiment, the discharge developer-conveying member 53 is described as utilizing a hollow helical screw shape. However, this should not be considered as limiting. The discharge developer-conveying member 53 may be formed in various structures as long as the structure allows the developer to flow back from the outlet 50*a*. For example, the discharge developer-conveying member 53 may be formed in a shape similar to the supply developer-conveying member 21 and 22 as described above.

The developer-receiving portion 51, as, e.g., illustrated in FIG. 10, may be formed so that the width W1 of the first portion 51*a*, in which the outlet 50*a* is formed, may be narrower than the width W2 of the second portion 51*b* of the developer-receiving portion 51. For example, the width W1 of the first portion 51*a* may be formed to be of the size corresponding to the small diameter portion 53*a* of the discharge developer-conveying member 53.

Figure 13:
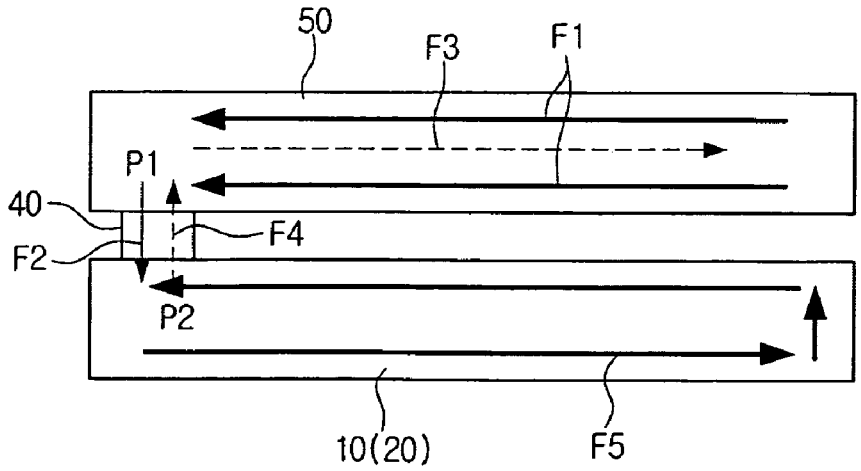
FIG. 13 is a sectional view conceptually illustrating a developing apparatus usable with an image forming apparatus according to an embodiment of the present invention.
Figure 14:
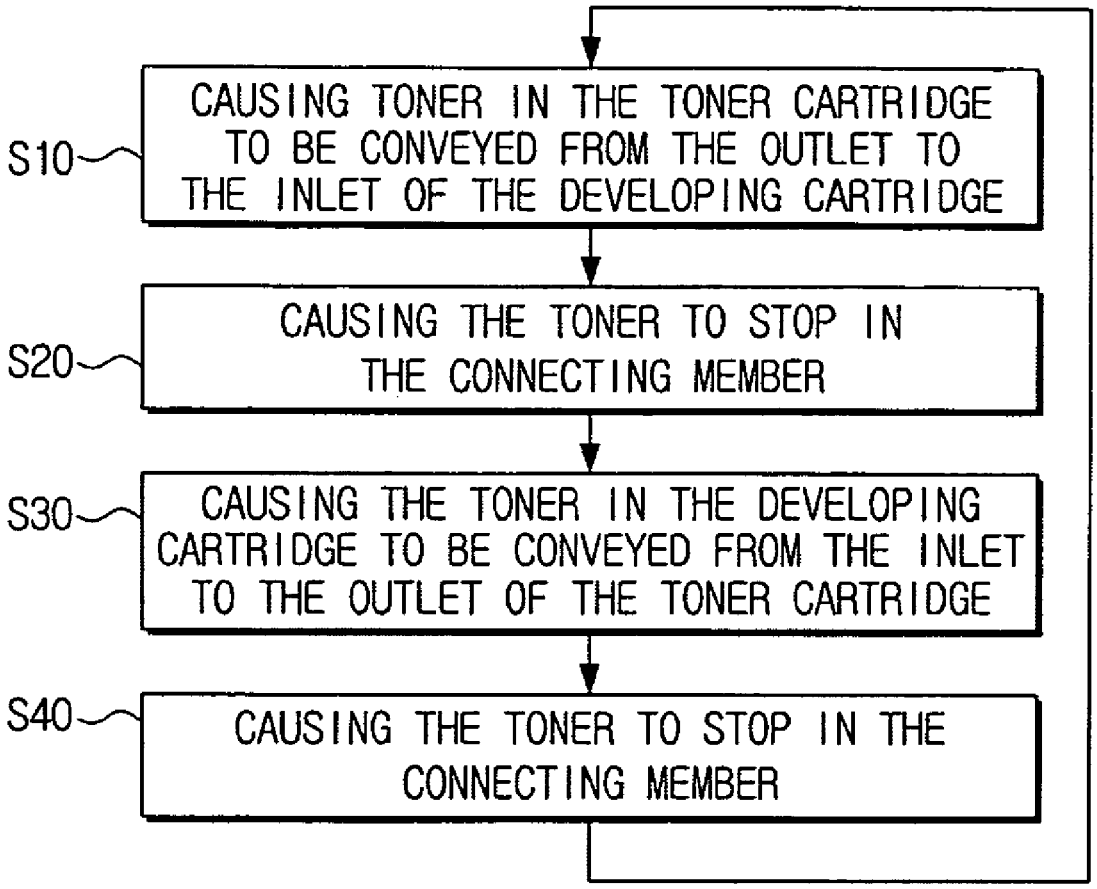
FIG. 14 is a flowchart illustrating a developer supplying method of a developing apparatus according to an embodiment of the present invention.

FIG. 13 is a sectional view conceptually illustrating the developing apparatus 1 usable with an image forming apparatus according to the above described embodiments. FIG. 14 is a flowchart illustrating a developer supplying method of the developing apparatus 1 usable with an image forming apparatus according to an embodiment. Hereinafter, an embodiment of the processes of supplying developer using the developing apparatus 1 will be described with reference to FIGS. 13 and 14.

When the developer pressure in the vicinity of the outlet 50*a* of the developer cartridge 50 is referred to the discharging pressure P1, and the developer pressure in the vicinity of the inlet 20*a* of the developing cartridge 10 is referred to the entering pressure P2, there may be a supplying mode, a stopping mode, and a back flowing mode inside the developing apparatus 1 according to the changes in the discharging pressure P1 and the entering pressure P2. The supplying mode represents a case in which the developer of the developer cartridge 50 moves to the developing cartridge 10 through the connecting member 40 (see arrows F1 and F2). The back flowing mode represents a case in which the developer of the developing cartridge 10 moves to the developer cartridge 50 through the connecting member 40 (see arrows F3 and F4). The stopping mode represents a case in which the developer does not move through the connecting member 40.

The developer in the developer-storing portion 20 of the developing cartridge 10 is circulated in the direction indicated by the arrow F5, and is conveyed to the developing roller 13 by, e.g., the two supply developer-conveying members 21 and 22, to be consumed. As the developer of the developing cartridge 10 is consumed, the entering pressure P2 may decrease to a level lower than the discharging pressure P1. This represents the supplying mode, in which the developer of the developer cartridge 50 moves to the developing cartridge 10 in the direction indicated by the arrow F2 (Step 10).

As the developer of the developer cartridge 50 moves to the developing cartridge 10 through the connecting member 40, the pressure in the developing cartridge 10 may increase so feat the entering pressure P2 becomes substantially the same as the discharging pressure P1. When the entering pressure P2 becomes the same as the discharging pressure P1, the stopping mode occurs so that the developer of the developer cartridge 50 does not move to the developing cartridge 10 through the connecting member 40 (Step 20).

When the entering pressure P2 becomes higher than the discharging pressure P1 the back flowing mode may occur so feat the developer of the developing cartridge 10 may move to the developer cartridge 50 through the connecting member 40 as arrow F4 (step S30). As the developer of the developing cartridge 10 is consumed, the entering pressure P2 gradually becomes lower. As a result, the entering pressure P2 of the developing cartridge 10 may become substantially the same as the discharging pressure P1 of the developer cartridge 50, entering once again the stopping mode (step S40). The entering pressure P2 eventually becomes lower than the discharging pressure P1. So the developer in the connecting member 40 moves again to the developing cartridge 10. Therefore, during a printing operation, the developing apparatus 1 may repeat the above processes of the supplying mode -> the stopping mode -> the back flowing mode -> stopping mode -> supplying mode, and so on, thereby constantly maintaining the amount of the developer in the developer-storing portion 20 of the developing cartridge 10.

On the other hand, since the discharge developer-conveying member 53 of the developer cartridge 50 is formed in the hollow helical screw shape, in the back flowing mode in which the developer of the developing cartridge 10 flows back to the developer cartridge 50 through the connecting member 40, the developer entering the developer cartridge 50 moves along the hollow portion 57 of the discharge developer-conveying member 53 in the direction opposite to the outlet 50*a*. As a result, the discharging pressure P1 in the vicinity of the outlet 50*a* may decrease.

Hereinafter, operation of the developing apparatus 1 having the above-described structure will be explained with reference to FIGS. 2, 10 and 15.

When the developer cartridge 50 is mounted in the mounting recess 30 of the developing cartridge 10, the outlet 50*a* of the developer cartridge 50 may be located above the connecting member 40. When the developing cartridge 10 with the developer cartridge 50 is mounted to the image forming apparatus 100, the developer of the developer cartridge 50 is supplied to the developing cartridge 10 through the outlet 50*a*. That is, when the developing cartridge 10 having the developer cartridge 50 mounted in the mounting hole recess thereof is mounted in the image forming apparatus 100, the discharge developer-conveying member 53 of the developer cartridge 50 receives power from the image forming apparatus 100, and may rotate. When the discharge developer-conveying member 53 rotates, the developer stored in the developer-receiving portion 51 of the developer cartridge 50 moves to the outlet 50*a*, and is discharged to the connecting member 40.

The developer discharged to the connecting member 40 enters the developer-storing portion 20 of the developing cartridge 10 through the inlet 20*a*. The developer entering the developer-storing portion 20 is conveyed by, e.g., the two supply developer-conveying members 21 and 22, and is supplied to the developer supplying roller 14. The developer supplying roller 14 supplies the developer to the developing roller 13. The developer supplied onto the surface of the developing roller 13 moves to the image carrier 12, and develops the electrostatic latent images formed on the image carrier 12 into developer images.

As the developer moves to the image carrier 12, and is used up, the entering pressure P2 in foe inlet 20*a* of the developing cartridge 10 becomes lower. When the entering pressure P2 of the developing cartridge 10 becomes lower, the developer of the developer cartridge 50 is supplied to the developing cartridge 10. After the developer of the developer cartridge 50 is supplied so that the entering pressure P2 of the developing cartridge 10 becomes higher, the developer of the developer cartridge 50 is not supplied or the developer of the developing cartridge 10 flows back the developer cartridge 50. Therefore, the developer in the developer-storing portion 20 of the developing cartridge 10 is constantly maintained. The developer moving statuses according to changes of the entering pressure P2 and the discharging pressure P1 are described above. Therefore, detailed descriptions thereof are not repeated.

Figure 15:
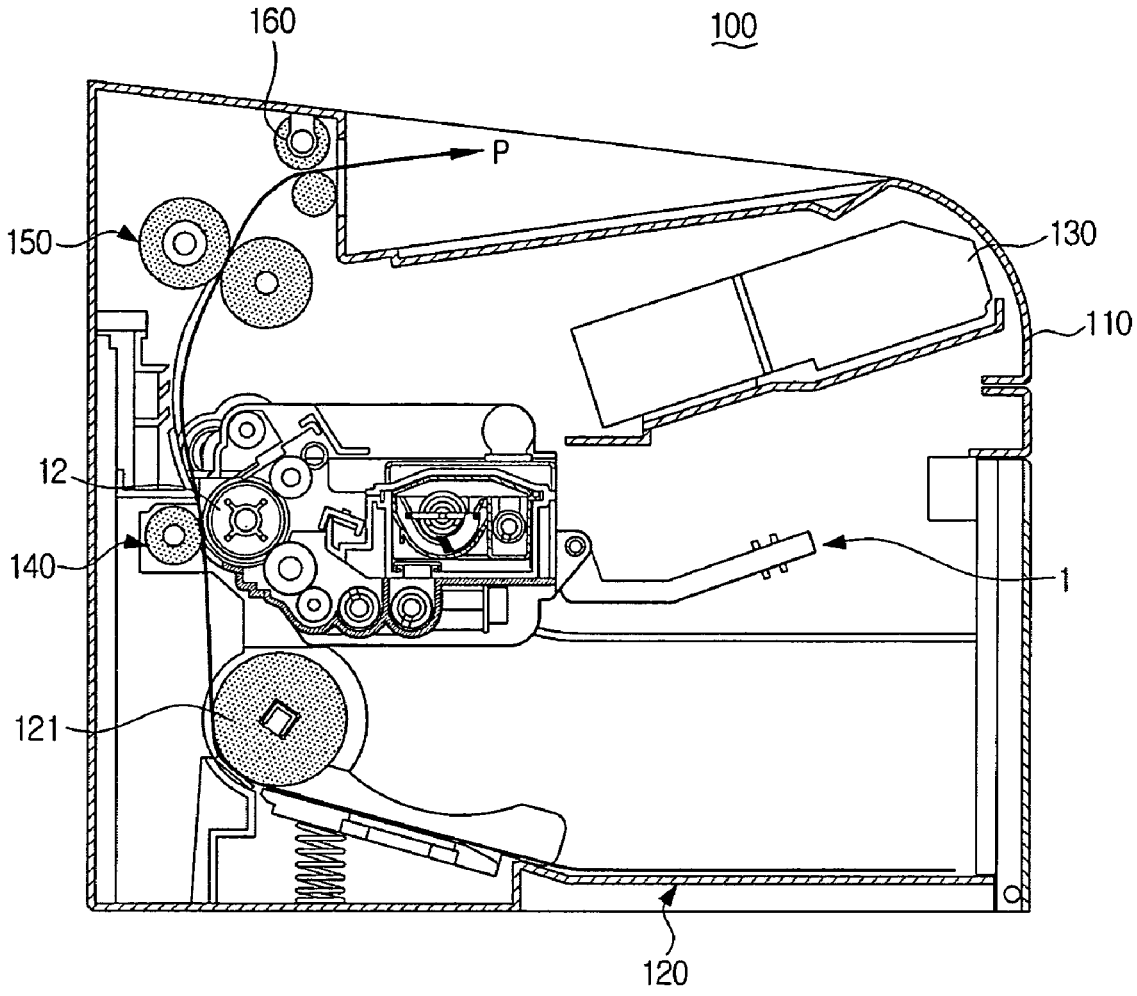
FIG. 15 is a sectional view illustrating an image forming apparatus using a developing apparatus according to an embodiment of the present invention.

FIG. 15 is a sectional view schematically illustrating an image forming apparatus 100 using a developing apparatus 1 according to an embodiment of the present invention.

Referring to FIG. 15, the image forming apparatus 100 according to an embodiment may include a case 110, a printing medium feeding unit 120, an exposure unit 130, the developing apparatus 1, a transferring roller 140, a fixing unit 150, and a discharging roller 160.

The case 110 forms an appearance of the image forming apparatus 100, and may support the printing medium feeding unit 120, the exposure unit 130, the developing apparatus 1, the transferring roller 140, the fixing unit 150, and the discharging roller 160.

The printing medium feeding unit 120 stores printing media P, and picks up the printing media P one by one to feed the printing medium P to the developing apparatus 1. To that end, a pickup roller 121 may be disposed at the leading end of the printing medium feeding unit 120.

The exposure unit 130 emits a laser beam corresponding to print data to form electrostatic latent images on the image carrier 12 of the developing apparatus 1.

The developing apparatus 1 stores a quantity of developer, and develops the electrostatic latent images formed on the image carrier 12 into developer images. The developing apparatus 1 is detachably disposed in the case 110. When the developing apparatus 1 is disposed in the case 110, a power is transmitted from a driving apparatus (not illustrated) disposed inside the case 110 so that the image carrier 12, the developing roller 13, the supply developer-conveying members 21 and 22, and/or the discharge developer-conveying member 53 rotate. The structure and operation of the developing apparatus 1 are described above; therefore, a detailed description thereof will not be repeated.

The transfer roller 140 causes the developer images formed on the image carrier 12 to be transferred onto the printing medium P.

The fixing unit 150 causes the developer images transferred onto the printing medium P to be fixed onto the printing medium P. The discharging roller 160 discharges the printing medium P having the developer images fixed thereon outside the image forming apparatus 100.

Accordingly, when receiving a printing order, the image forming apparatus 100 controls the exposure unit 130 to emit a laser beam corresponding to printing data and form electrostatic latent images corresponding to the printing data on the image carrier 12 of the developing apparatus 1. Them the developing roller 13 of the developing apparatus 1 supplies developer to the image carrier 12, thereby developing the electrostatic latent images into developer images. In the developing apparatus 1 according to an embodiment, the developer in the developer-storing portion 20 of the developing cartridge 10 is constantly maintained.

The image forming apparatus 100 also controls the printing medium feeding unit 120 to pick up and feed a printing medium P between the transfer roller 140 and the image carrier 12. Then, the developer images are transferred from the image carrier 12 to the printing medium P.

The printing medium P having the developer images transferred thereon passes through the fixing unit 150 and the discharging roller 160, thereby being discharged outside the image forming apparatus 100.

With the developing apparatus 1 usable with the image forming apparatus according to the above-described embodiments, when the developer runs out, only the developer cartridge 50 can be required to be replaced with a new developer cartridge.

Also, with the developing apparatus 1 usable with the image forming apparatus of the embodiments herein described, during supplying the developer from the developer cartridge 50 to the developing cartridge 10 when the pressure in foe developing cartridge 10 and the connecting member 40 is increased over a predetermined pressure, although the supply developer-conveying member 53 continues to rotate for supplying the developer, the developer does not move to the developing cartridge 10 and/or the developer may flow back from the developing cartridge 10 to the developer cartridge 50 so that the amount of developer in the developing cartridge 10 is continuously maintained.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A developing apparatus usable with an image forming apparatus, comprising:

a developer cartridge comprising:

an outlet; and a developer conveying member to rotate about a rotation axis, to move developer in the developer cartridge; and a developing cartridge comprising:

a mounting recess in which the developer cartridge is detachably disposed, the mounting recess configured to receive the developer cartridge in a direction substantially parallel to the rotation axis of the developer conveying member;

an inlet through which the developer discharged from the outlet of the developer cartridge enters the developing cartridge; and a connecting member extending into the mounting recess and configured to guide the developer from the outlet of the developer cartridge to the inlet of the developing cartridge, wherein the height of the connecting member is smaller than the maximum width of the inlet of the developing cartridge.

2. The developing apparatus of claim 1, wherein the height of the connecting member and an area of the inlet of the developing cartridge satisfying the formula $A \geqq 10 \times H$, where H is the height of the connecting member in a measurement unit, and A is the area of the inlet of the developing cartridge in the measurement unit squared.

3. The developing apparatus of claim 1, wherein the developer-conveying member substantially has a shape of a hollow helical screw.

4. The developing apparatus of claim 1, wherein the developer-conveying member comprises helical blades having portions that are cut out to form blade segments.

5. The developing apparatus of claim 1, wherein the developer conveying member comprises:

a conveying portion to convey the developer in the first direction toward the outlet; and a backflow portion configured to move the developer in a second direction opposite to the first direction, according to pressures at the outlet of the developer cartridge and the inlet of the developing cartridge.

6. The developing apparatus of claim 1, wherein the developer cartridge comprises a mounting guide, and the mounting recess of the developing cartridge comprises a mounting guiding groove corresponding to the mounting guide.

7. The developing apparatus of claim 5, wherein the developer conveying member is configured to move the developer in the first direction, when an outlet pressure at the outlet of the developer cartridge is larger than an inlet pressure at the inlet of the developing cartridge, and to allow the developer to move in the second direction, when the outlet pressure at the outlet of the developer cartridge is smaller than the inlet pressure at the inlet of the developing cartridge.

8. The developing apparatus of claim 7, wherein the developer conveying member rotates in the same direction regardless of whether the developer moves in the first direction or in the second direction.

9. The developing apparatus of claim 7, wherein the developer conveying member is further configured to allow a stop condition, in which the toner does not move in either the first or the second direction when the outlet pressure at the outlet of the developer cartridge substantially equals the inlet pressure at the inlet of the developing cartridge.

10. A developing apparatus usable with an image forming apparatus, comprising:

a developer cartridge comprising:

an outlet through which developer is discharged out of the developer cartridge; and a developer conveying member to move the developer in the developer cartridge; and a developing cartridge comprising:

a mounting recess into which the developer cartridge is detachably received;

an inlet to receive the developer discharged from the outlet of the developer cartridge; and a connecting member that extends into the mounting recess, and configured to guide the developer from the outlet of the developer cartridge to the inlet of the developing cartridge, wherein the developer conveying member is configured to move the developer in a first direction, towards the outlet of the developer cartridge, and in an opposing second direction, away from the outlet of the developer cartridge, according to a changes in a discharging pressure at the outlet of the developer cartridge and an entering pressure at the inlet of the developing cartridge.

11. The developing apparatus of claim 10, wherein the developer moves in the first direction when the discharging pressure at the outlet of the developer cartridge is larger than the entering pressure at the inlet of the developing cartridge, and in the second direction when the discharging pressure at the outlet of the developer cartridge is smaller than the entering pressure at the inlet of the developing cartridge.

12. The developing apparatus of claim 11, wherein the developer does not move in either the first or the second direction when the discharging pressure at the outlet of the developer cartridge substantially equals the entering pressure at the inlet of the developing cartridge.

13. The developing apparatus of claim 10, wherein:

the connecting member connects the outlet of the developer cartridge and the inlet of the developing cartridge, so as to allow the developer to be supplied from the developer cartridge to the developing cartridge; and the height of the connecting member is smaller than the maximum width of the inlet of the developing cartridge.

14. The developing apparatus of claim 13, wherein the height of the connecting member and an area of the inlet of the developing cartridge satisfy the equation $A \geqq 10 \times H$, where H is the height of the connecting member a measurement unit, and A is the area of the inlet of the developing cartridge the measurement unit squared.

15. The developing apparatus of claim 10, wherein the discharge developer conveying member comprises a substantially hollow backflow portion and a helical blade disposed around the backflow portion.

16. The developing apparatus of claim 10, wherein the discharge developer conveying member comprises a substantially hollow backflow portion and helical blades disposed around the backflow portion, the helical blades having cut outs to form helical blade segments.

17. The developing apparatus of claim 10, wherein the developer cartridge comprises a mounting guide, and the mounting recess of the developing cartridge comprises a mounting guiding groove corresponding to the mounting guide.

18. The developing apparatus of claim 10, wherein the discharge developer conveying member comprises:

a conveying portion to convey the developer in a third direction toward the outlet; and a backflow portion configured to allow the developer to move in a fourth direction opposite to the third direction when the discharging pressure at the outlet of the developer cartridge becomes less than the entering pressure at the inlet of the developing cartridge.

19. The developing apparatus of claim 18, wherein the discharge developer conveying member rotates in the same direction regardless of whether the developer moves in the third direction or in the fourth direction.

20. The developing apparatus of claim 10, wherein the connecting member extends from the inlet to the outlet of the developer cartridge.

21. An image forming apparatus, comprising:

an image carrier configured to support an electrostatic latent image;

a developer cartridge comprising:

an outlet through which developer is discharged from the developer cartridge; and a developer conveying member to move the developer in the developer cartridge and comprising a substantially hollow backflow portion and a helical blade disposed around the backflow portion;

a developing cartridge to receive the developing cartridge and to supply the developer to the image carrier to develop the electrostatic latent image into a developer image, the developing cartridge comprising:

an inlet to receive the developer discharged from the outlet of the developer cartridge; and a connecting member to guide the developer from the outlet of the developer cartridge to the inlet of the developing cartridge; and a transferring unit to transfer the developer images from the image carrier to a printing medium.

22. An image forming apparatus comprising:

an image carrier configured to support an electrostatic latent image;

a developing apparatus to supply developer to the image carrier to develop the electrostatic latent images on the image carrier into developer images, the developing apparatus comprising:

a developer cartridge comprising:

an outlet through which developer is discharged out of the developer cartridge; and a developer conveying member to move the developer in the developer cartridge;

a developing cartridge comprising:

a mounting recess into which the developer cartridge is detachably received;

an inlet to receive the developer discharged from the outlet; and a connecting member to guide the developer from the outlet of the developer cartridge to the inlet of the developing cartridge, wherein the developer conveying member is configured to move the developer in a first direction, towards the outlet of the developer cartridge, and in an opposing second direction, away from the outlet of the developer cartridge, according to changes in a discharging pressure at the outlet of the developer cartridge and an entering pressure at the inlet of the developing cartridge; and a transferring unit to cause the developer images formed on the image carrier to be transferred onto a printing medium.

23. A method of supplying developer in a developing apparatus usable with an image forming apparatus, comprising:

conveying developer in a developer cartridge in a first direction to an outlet of the developer cartridge;

conveying the developer in a second direction from the outlet of the developer cartridge to an inlet of a developing cartridge through a connecting member, the connecting member extending from the inlet;

causing the developer to stop in the connecting member; and conveying the developer in the developing cartridge in a third direction opposite the second direction, from the inlet of the developing cartridge to the outlet of the developer cartridge, and inside of the connecting member.

24. The method as set forth in claim 23, wherein each of the steps of conveying the developer in the developer cartridge from the outlet of the developer cartridge to the inlet of a developing cartridge, causing the developer to stop in the connecting member, and conveying the developer in the developing cartridge from the inlet of the developing cartridge to the outlet of the developer cartridge are carried out in succession according to a change of an entering pressure in the inlet of the developing cartridge.

25. A developer cartridge detachably mountable in a developing cartridge to supply the developing cartridge with developer, comprising:

a developer receiving portion to store the developer comprising a first portion in and a second portion, a bottom surface of the second portion being lower than a bottom surface of the first portion, an outlet disposed in the bottom surface of the first portion of the developer receiving portion, to discharge the developer from the developer receiving portion; and a substantially hollow developer conveying member disposed inside the developer receiving portion and comprising a small diameter portion corresponding to the first portion of the developer receiving portion, a large diameter portion corresponding the second portion of the developer receiving portion, and helical blades disposed around the large and small diameter portions, wherein the outlet is formed to correspond to a shape of a connecting member disposed in the developing cartridge, the maximum width of the outlet of the developer cartridge being larger than the height of the connecting member, the connecting member extending from an inlet of the developing cartridge, wherein, in the large diameter portion, the widths of the blades respectively increase towards the small diameter portion.

26. The developer cartridge of claim 25, wherein the developer conveying member comprises:

a conveying portion to convey the developer in the first direction toward the outlet; and a backflow portion configured to move the developer in a second direction opposite to the first direction, when a discharging pressure at the outlet becomes greater than a conveying pressure resulting from the movement of the developer in the first direction.

27. The developer cartridge of claim 25, wherein the developer conveying member comprises a helical blade disposed around a substantially hollow backflow portion.

28. The developer cartridge of claim 25, wherein the width of the second portion is greater than the width of the first portion.

29. The developer cartridge of claim 25, further comprising:

a waste developer receiving portion formed adjacent the developer receiving portion.

30. A developer cartridge detachably mountable in a developing cartridge to supply the developing cartridge with developer, comprising:

a developer receiving portion to store the developer comprising a first portion in and a second portion, a bottom surface of the second portion being lower than a bottom surface of the first portion, an outlet disposed in the bottom surface of the first portion of the developer receiving portion, to discharge the developer from the developer receiving portion; and a substantially hollow developer conveying member disposed inside the developer receiving portion and comprising a small diameter portion corresponding to the first portion of the developer receiving portion, a large diameter portion corresponding the second portion of the developer receiving portion, and helical blades disposed around the large and small diameter portions, wherein the outlet is formed to correspond to a shape of a connecting member disposed in the developing cartridge, a maximum width of the outlet of the developer cartridge being larger than a height of the connecting member, the connecting member projecting and extending from an inlet of the developing cartridge, wherein the large diameter portion of the developer-conveying member is formed such that a width of the blade adjacent to the small diameter portion has a sufficient diameter to extend over a step created by a difference in heights of bottom surfaces of the first and second portions.

31. A developing apparatus usable with an image forming apparatus, comprising:

a developer cartridge comprising:

an outlet through which developer is discharged out of the developer cartridge; and a developer conveying member disposed in the developer cartridge and comprising a conveying portion to convey the developer toward the outlet, and a backflow portion configured to move the developer away from the outlet; and a developing cartridge to house the developer cartridge and comprising an inlet to receive the developer discharged from the outlet of the developer cartridge, wherein the backflow portion is configured to move the developer away from the outlet, when the amount of developer in the developing cartridge results in an increase in developer pressure at the inlet of the developing cartridge.

* * * * *